US009885477B2

(12) United States Patent
Adkins

(10) Patent No.: US 9,885,477 B2
(45) Date of Patent: Feb. 6, 2018

(54) SEMI-SUBMERSIBLE GAS BURNER

(71) Applicant: Michael S. Adkins, Vandalia, OH (US)

(72) Inventor: Michael S. Adkins, Vandalia, OH (US)

(73) Assignee: HEARTH PRODUCTS CONTROLS CO., Kettering, OH (US)

( * ) Notice: Subject to any disclaimer, the term of this patent is extended or adjusted under 35 U.S.C. 154(b) by 353 days.

(21) Appl. No.: 14/746,459

(22) Filed: Jun. 22, 2015

(65) Prior Publication Data

US 2016/0370004 A1 Dec. 22, 2016

(51) Int. Cl.

| | |
|---|---|
| ***F23D 14/10*** | (2006.01) |
| ***F23D 99/00*** | (2010.01) |
| ***B05B 17/00*** | (2006.01) |
| ***F23Q 9/00*** | (2006.01) |
| ***F23D 14/26*** | (2006.01) |
| *F21V 37/00* | (2006.01) |

(52) U.S. Cl.

CPC ..... *F23D 91/00* (2015.07); *B05B 17/00* (2013.01); *F23D 14/10* (2013.01); *F23D 14/26* (2013.01); *F23Q 9/00* (2013.01); *F21V 37/00* (2013.01); *F23D 2900/00018* (2013.01)

(58) Field of Classification Search

CPC ..... F21V 37/00; F23D 91/00; B05B 17/00; F23Q 9/00

USPC ..... 431/202, 350, 354; 126/360.1

See application file for complete search history.

(56) References Cited

U.S. PATENT DOCUMENTS

| | | | | |
|---|---|---|---|---|
| 2,723,659 | A * | 11/1955 | Young | F23C 3/004 126/360.1 |
| 3,516,773 | A * | 6/1970 | Larson | F23D 14/04 431/284 |
| 6,871,793 | B2 * | 3/2005 | Rumens | B05B 17/08 239/16 |
| 7,075,189 | B2 * | 7/2006 | Heronemus | B63B 1/047 290/44 |
| 7,628,608 | B1 * | 12/2009 | Doyle | F21S 8/00 137/599.01 |
| 9,011,142 | B2 * | 4/2015 | Muff | F23N 5/102 431/22 |
| 2011/0132993 | A1 * | 6/2011 | Wiseman | B05B 15/00 239/17 |

* cited by examiner

*Primary Examiner* — Gregory Huson
*Assistant Examiner* — Nikhil Mashruwala
(74) *Attorney, Agent, or Firm* — Thompson Hine LLP

(57) ABSTRACT

A semi-submersible gas burner assembly for a fire-on-water feature, the assembly including a tubular void former having nominal waterline disposed between proximal and distal ends and a separable lid engaging the distal end. The lid includes inner and outer peripheral skirts projecting toward and past the waterline, respectively. At least one gas manifold arm extends through and outward from the tubular void former, and includes a gas port disposed proximate the sidewall. The sidewall at the distal end includes a communicating aperture which fluidly interconnects the interior of the tubular void former with a flame retention chamber defined by the sidewall, the lid, the inner peripheral skirt of the lid, and the nominal waterline.

20 Claims, 8 Drawing Sheets

SEMI-SUBMERSIBLE GAS BURNER

TECHNICAL FIELD

The present invention relates to fire effect systems and, in particular, to a semi-submersible gas burner assembly for use in fountains and other artificial water features.

BACKGROUND

Gas burner assemblies used for producing fire effects in fountains, ponds, and other water features typically deliver a combustible gas, such natural gas or propane, to one or more nozzles or frits disposed beneath the surface of the water. Such burner assemblies may be match-lit or may include an electronic ignition module. Electronic ignition modules provide a pilot gas nozzle and an ignition source, such as a glow plug or hot wire igniter, disposed above the surface of the water, and operate during start-up in order to ignite first the pilot, then gas emerging from the water via the submerged nozzles or fits. Assemblies also commonly include a thermocouple, thermopile, or other sensor that senses when the burner assembly has been ignited. The output of the sensor is used to stop the flow of gas if the burner assembly blows out or otherwise becomes extinguished, and also may be used to control operation of the pilot gas nozzle and ignition source in any electronic ignition module (to provide an intermittent or interrupted pilot light feature). The burner assembly may include one or more mesh screens which surround the pilot gas nozzle, sensor, and other components to mechanically protect those components. Systems known to the applicant require a minimum gas supply pressure of at least 2.0 psig, which is an elevated delivery pressure in comparison to the 6-14 inch water column (0.25-0.5 psig) gas pressures commonly employed as "standard pressure" in residential (in-home) gas distribution.

Existing gas burner assemblies appear to rely upon high gas supply pressures and high nozzle outputs to both push fuel through the submerged nozzles or fits and maintain a flame in outdoor conditions. Notably, ANSI standard Z21.97 and corresponding CSA standard 2.41 require that systems with flame sensors light and remain burning in a 10 mph horizontal breeze. But such gas supply pressure requirements are frequently incompatible with existing residential gas supplies, which although optionally upgradable to 2.0 psig service at the service entry/gas meter would also require the installation of in-line pressure regulators for each of the residence's "standard pressure"-rated appliances. Finally, common residential gas distribution piping may cause substantial pressure losses at the gas flow rates required to supply a high BTU, remotely located device such as patio or in-yard installed fire-on-water feature, requiring the replacement of existing small diameter piping, the installation of new or replacement large diameter piping, and careful evaluation of the number of piping elbows and bends necessary to reach the desired feature location.

SUMMARY

The present application discloses a new semi-submersible gas burner assembly which is operable at "standard" residential gas distribution pressures of 0.5 psig or less. The gas burner assembly includes a tubular void former which provides combustion air to an internal pilot chamber as well as to an external flame retention chamber that is fed by a submerged gas port. The gas burner assembly further includes a lid that provides a pair of depending peripheral skirts in order to create a tortuous path for combustion air drawn in from proximate the surface of the water. The combination of the tubular void former and the lid defines a external flame retention chamber, with the internal pilot chamber providing enhanced start-up capabilities in gentle-to-moderate breeze conditions, the external flame retention chamber providing enhanced blow-out resistance in strong breeze conditions, and the peripheral skirts shielding the flame retention chamber while providing a path for flame propagation back to the open surface of the water.

According to a first aspect, a semi-submersible gas burner assembly includes a tubular void former having a proximal end, a distal end, and a nominal waterline defining a plane disposed between the proximal and distal ends. The gas burner assembly further includes a lid engageable with the distal end of the tubular void former, the lid including an inner peripheral skirt disposed outside of and spaced apart from the tubular void former, the inner peripheral skirt projecting toward the plane when the lid is engaged with the tubular void former, an outer peripheral skirt disposed outside of and spaced apart from the inner peripheral skirt, the outer peripheral skirt projecting toward and past the plane when the lid is engaged with the tubular void former, and a distal surface substantially closing off the area of the lid bounded by the inner peripheral skirt. The gas burner assembly yet further includes at least one gas manifold arm extending through and outward from a sidewall of the tubular void former, with at least one gas port formed in the outward portion of the gas manifold arm proximate the sidewall of the tubular void former. The sidewall of the tubular void former includes a communicating aperture disposed between the distal end of the tubular void former and the plane, the communicating aperture fluidly interconnecting the interior of the tubular void former with a flame retention chamber defined by the sidewall of the tubular void former, the distal surface of the lid, the inner peripheral skirt, and the nominal waterline.

According to a second aspect, a fire effect system comprises a bowl with nominal waterline, a passage disposed below the nominal waterline, and a semi-submersible gas burner assembly sealingly engageable with the passage. The semi-submersible gas burner assembly includes a tubular void former having a proximal end engaging the bowl about the passage and an opposing distal end. The assembly further includes a lid engageable with the opposing distal end, the lid including an inner peripheral skirt disposed outside of and spaced apart from the tubular void former, the inner peripheral skirt projecting toward the nominal waterline when the lid is engaged with the tubular void former, an outer peripheral skirt disposed outside of and spaced apart from the inner peripheral skirt, the outer peripheral skirt projecting toward and past the nominal waterline when the lid is engaged with the tubular void former, and a distal surface substantially closing off the area of the lid bounded by the inner peripheral skirt. The gas burner assembly yet further includes at least one gas manifold arm extending through and outward from a sidewall of the tubular void former, with at least one gas port formed in the outward portion of the gas manifold arm proximate the sidewall of the tubular void former. The sidewall of the tubular void former includes a communicating aperture disposed between the distal end of the tubular void former and the nominal waterline, the aperture fluidly interconnecting the interior of the tubular void former with at least one flame retention chamber defined by the sidewall of the tubular void former, the distal surface of the lid, the inner peripheral skirt, and the nominal waterline of the bowl.

DETAILED DESCRIPTION

Figure 1A:
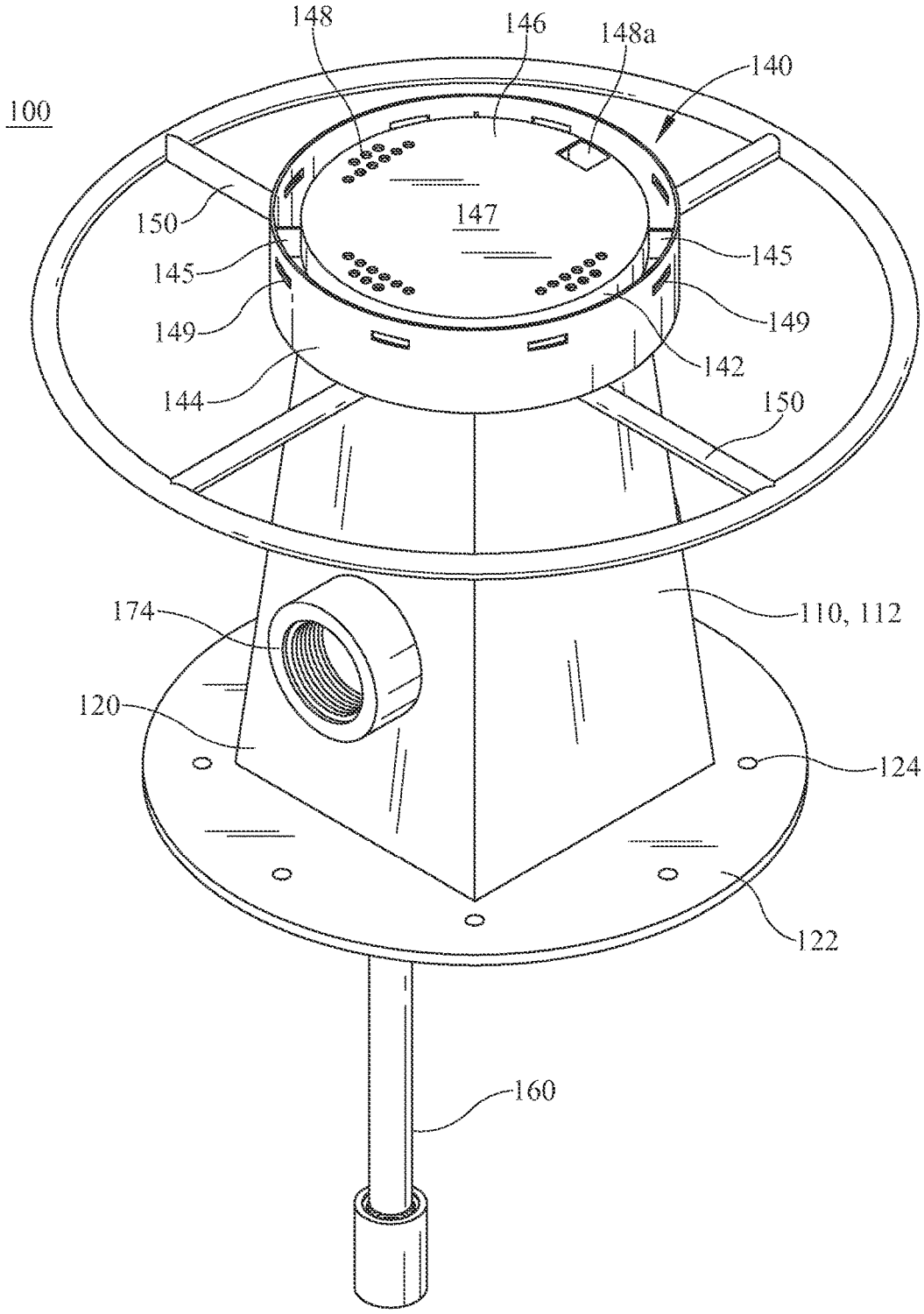
FIG. 1A is a perspective view of an embodiment of the semi-submersible gas burner assembly, oriented towards the distal end of the assembly.
Figure 1B:
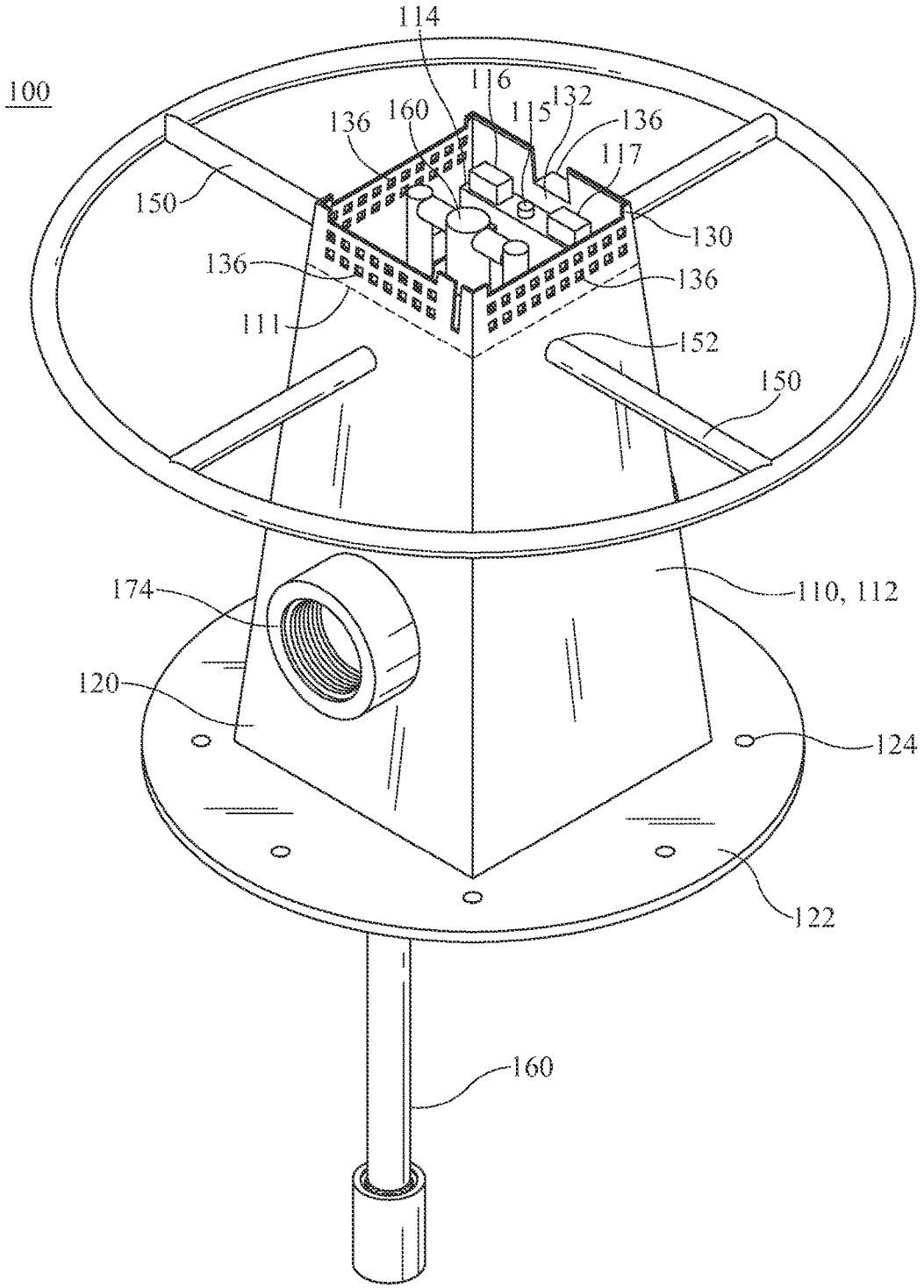
FIG. 1B is a perspective view of the embodiment of FIG. 1A, omitting the engageable lid in order to show other details of the tubular void former and contents.
Figure 2:
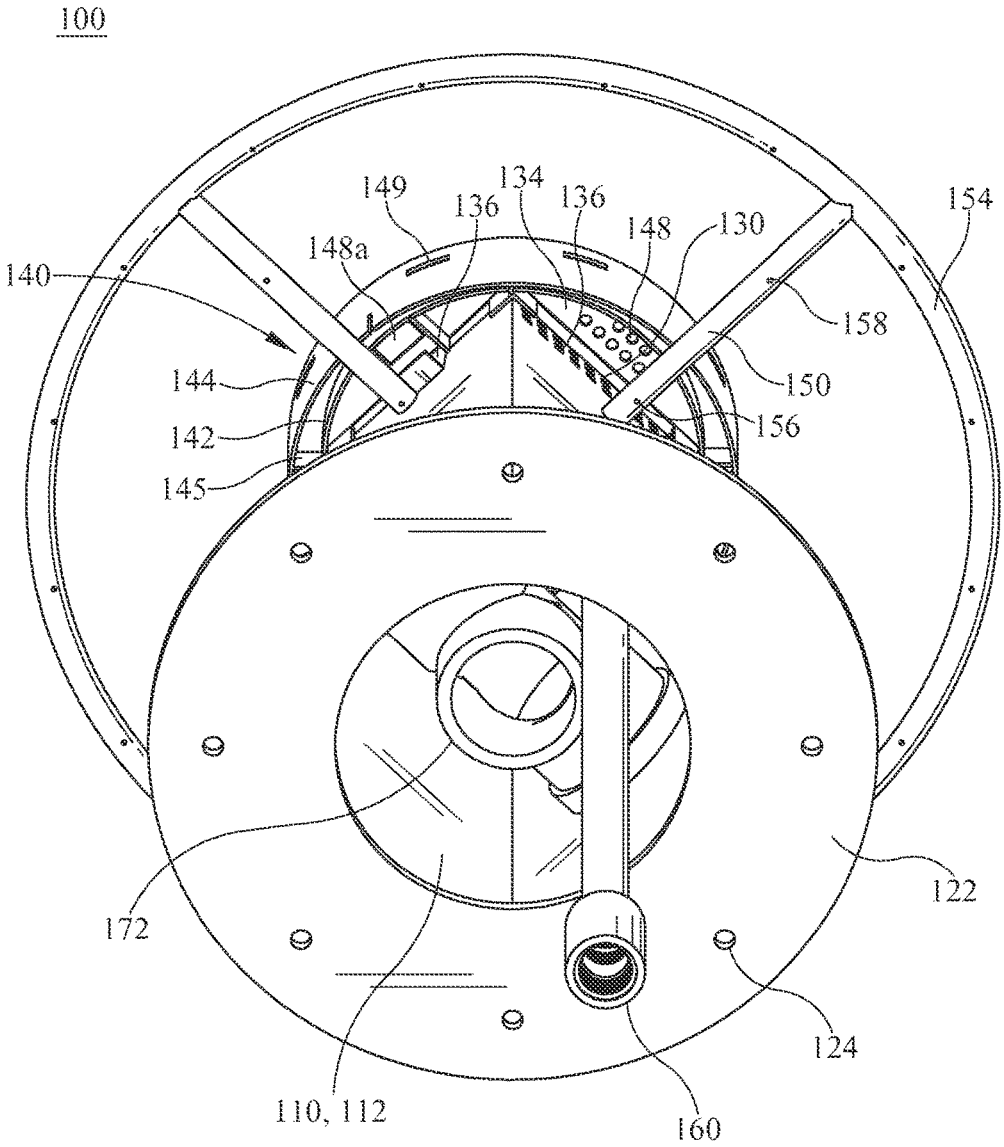
FIG. 2 is a perspective view of the embodiment of FIG. 1A, oriented towards the proximal end of the assembly.

Referring initially to FIGS. 1A, 1B, and 2, an exemplary embodiment of a semi-submersible gas burner assembly 100 is shown. The burner assembly 100 is based upon a tubular void former 110 having a proximal end 120, a distal end 130, and a nominal waterline "W." In some embodiments, a plane 111 defined by the nominal waterline "W" may be indicated by a marking provided on the tubular void former 110 itself. In other embodiments, the axial location of the plane 111 and the nominal waterline "W" may be defined by a measurement, such as a distance below the distal end 130, a distance below or above a portion of a separable lid 140 (e.g., distal or proximal ends of an outer peripheral skirt 144), a distance above a gas manifold arm 150, or a similar measurement that may be provided in printed literature accompanying the assembly 100, printed links to electronic literature made available through (for example) the internet, specifications provided to or made available to prospective distributors and/or customers, or the like. The plane 111 and nominal waterline "W" are disposed between the proximal and distal ends 120, 130 so that, in use, the distal end 130 and certain communicating apertures (discussed below) will be disposed above the waterline of a water feature. The plane 111 is preferably perpendicular to the longitudinal axis of the tubular void former 110, but may be angled with respect to it if the void former is configured for non-vertical installation. The tubular void former 110 is otherwise defined by a sidewall 112 which is shown with a tapering, square cross section, but which in other embodiments may have a tapering or non-tapering circular, triangular, rectangular, or other closed cross section. For sake of clarity, the cross section is preferably a regular geometric shape, but may be an irregular shape and may change, even substantially, between the proximal and distal ends 120 and 130 so long as it defines a continuous and preferably continuously hollow tube. The proximal end 120 may include a proximal flange 122, shown for illustrative purposes as an outwardly projecting flange, for sealing engagement with the bottom of an artificial water feature such as a fountain. The proximal flange 122 may include a plurality of apertures 124 for receiving fasteners (not shown) for securing the flange 122 and tubular void former 110 against the structure of the water feature, but it will be understood that that the flange 122 could be welded, adhered, clamped, or even in some configurations screwed or bayonet-connected to a mount disposed around the passage. The interior of the tubular void former 110 consequently forms a void within the water feature which may house an electronic ignition module 114, including a pilot gas nozzle 115, ignition source 116, and sensor 117, as well as convey combustion air from the base or lower portions of the water feature. Frequently such locations will offer a ready supply of becalmed and oxygenated combustion air.

The burner assembly 100 further includes a separable lid 140 configured to engage with the distal end 130 of the tubular void former 110. The lid 140 includes an inner peripheral skirt 142 that is disposed outside of and spaced apart from the outer surface of the tubular void former 110. As shown in FIG. 2, the inner peripheral skirt 142 may in fact contact the corners of the void former 110 at the distal end 130, but in general is spaced apart from the sidewall 112 at that distal end. The inner peripheral skirt 142 could alternately be entirely spaced apart from the outer surface of the tubular void former 110, which would produce greater interconnection of surrounding flame retention chambers (discussed below). The lid 140 further includes an outer peripheral skirt 144 disposed outside of and spaced apart from the inner peripheral skirt 142. The outer peripheral skirt 144 may be connected to and supported by the inner peripheral skirt via a plurality of support arms 145 arrayed between the two or, less preferably, by a rigid mesh or perforated material. The lid 140 yet further includes a distal surface 146 substantially closing off an the area 147 of the lid bounded by the inner peripheral skirt 142. For sake of clarity, substantially as used in this context permits the inclusion of a plurality of exhaust apertures 148. The plurality of exhaust apertures 148 should constitute less than 14% and, preferably, less than 7%, of the area 147.

Figure 5:
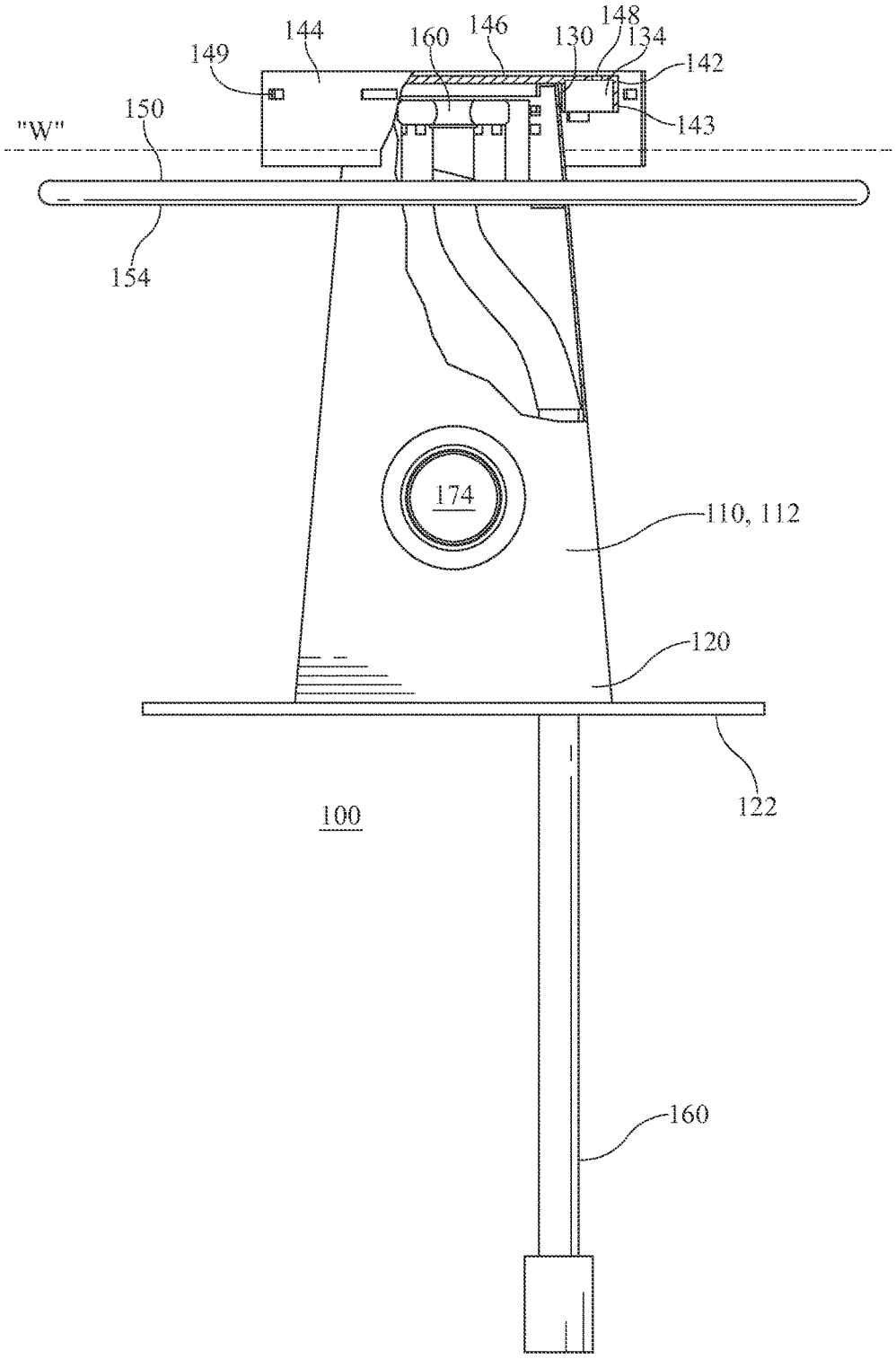
FIG. 5 is a first side view of the embodiment, including a cut-away view of the tubular void former and lid in order to show other details of the burner assembly and lid.

The lid 140 combines with the tubular void former 110 to form shielded combustion chambers at the distal end 130. A first, a pilot combustion chamber 132 disposed within the tubular void former 110, contains the pilot flame produced by the pilot gas nozzle 115. Combustion air may be drawn from within the tubular void former 110. Thus the pilot flame is shielded from the wind by the structures of the lid 140 and the sidewall 112 of the tubular void former 110, as well as the body of the electronic ignition module 114. A second, a flame retention chamber 134 disposed around the tubular void former, contains a flame produced by the combustion of gas from a submerged gas port disposed proximate the sidewall 112 of the tubular void former (discussed below). The inner peripheral skirt 142 projects from the lid 140 (as shown, the distal surface 146) toward the plane 111, but with a proximal end 143 of skirt 142 terminating short of the plane when the lid is engaged with the tubular void former 110, so that the proximal end 143 will be positioned above the nominal waterline. Combustion air is drawn from outside the lid 140, between the inner peripheral skirt 142 and the plane 111, and into a chamber 134 defined by the sidewall 112, the distal surface 146, the inner peripheral skirt, and an actual waterline which, in use, should generally correspond to the plane 111 and nominal waterline "W." As best shown in FIG. 5, in order to prevent blow-out the outer peripheral skirt 144 projects from the lid 140 (as shown, support arms 145 of lid 140) toward and past the plane 111 when the lid is engaged with the tubular void former 110, so that a proximal end of skirt 144 will be positioned below the nominal waterline. Thus, in general, combustion air drawn from outside the lid 140 must follow a tortuous path which passes between the inner and outer peripheral skirts 142 and 144, around the proximal end 143 of the inner peripheral skirt, and into the flame retention chamber 134. However, to prevent combustion air starvation in strong breeze conditions, it may be advantageous to include a plurality of inlet apertures 149 within the outer peripheral skirt 144 itself. The inlet apertures 149 are preferably disposed proximate the distal end of the skirt 144 (versus the proximal end 145) to maintain a tortuous path, but reduce the tendency of a strong breeze to produce a low pressure zone next to the inner peripheral skirt 142 in the lee of the outer peripheral skirt 144. Specifically, the inlet apertures 149 may be positioned distally of the proximal end 143 of the inner peripheral skirt 142 so that wind-driven air will impact the inner peripheral skirt, thus forcing incoming combustion air to divert toward the waterline, around the proximal end of the inner peripheral skirt, and into the chamber 134. Since the wind does not have direct access to the protected chamber 134, the retained flame cannot be easily extinguished.

Figure 6:
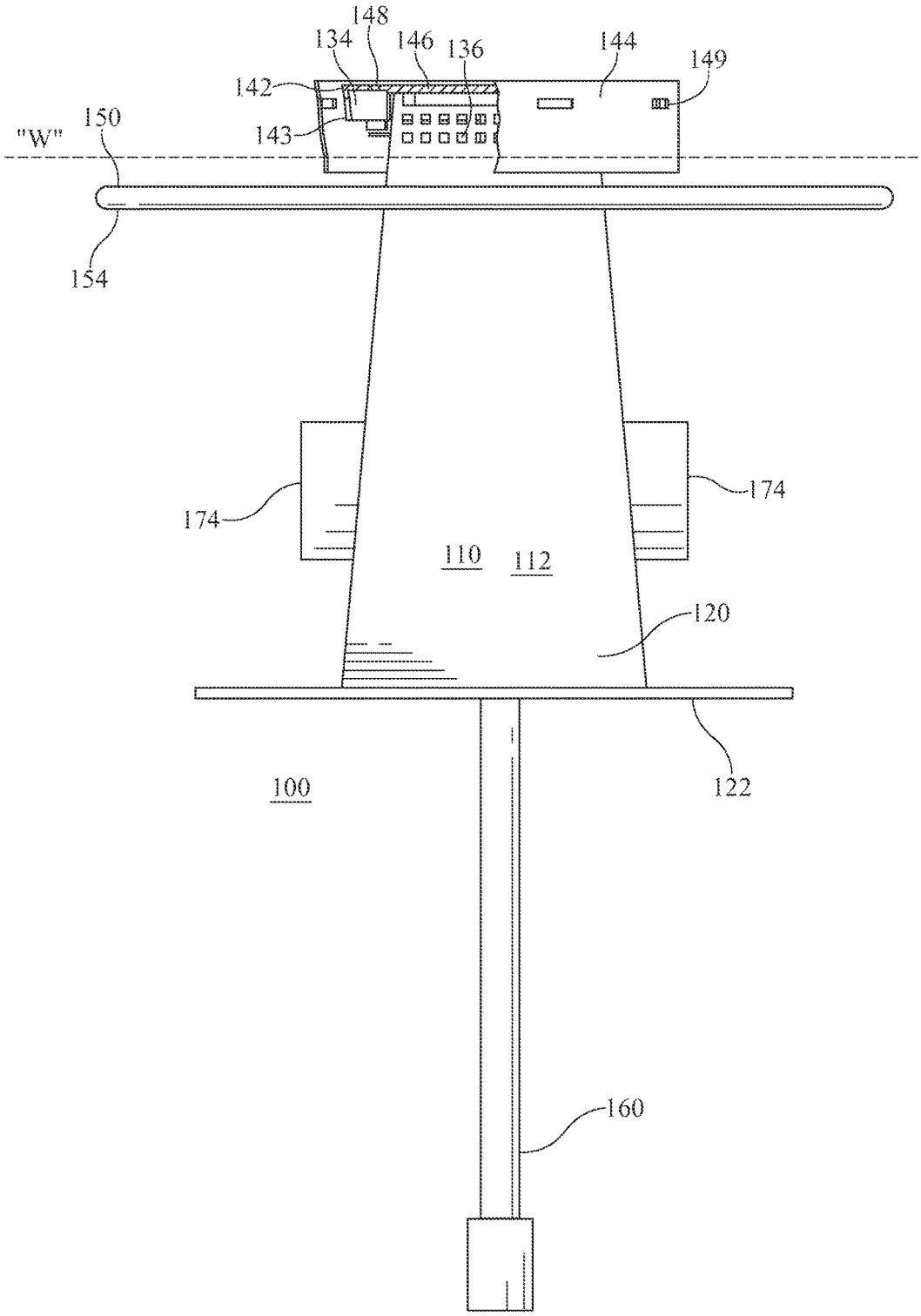
FIG. 6 is a second side view of the embodiment, rotated by 90 degrees, including a cut-away view of the engagable lid in order to show other details of the tubular void former and lid.

The lid 140 includes a plurality of exhaust apertures 148 which serve to allow exhaust products to escape the lid 140. A least one exhaust aperture is disposed adjacent the pilot gas nozzle 115 and ignition source 116. As shown in FIGS. 1A and 1B, an exhaust aperture 148*a* may be disposed in the lid 140 at a radial location outside the location of sidewall 112 of the tubular void former 110, adjacent to a communicating aperture 136 disposed in the sidewall 112 of the tubular void former which is directly adjacent to the pilot gas nozzle 115. The exhaust aperture 148*a* is preferably a single ⅝" by ½" opening, +/−⅛" but may be closely packed collection of openings (individual openings or a mesh) of equivalent opening area. This is sufficient to prevent extinguishment of the pilot light without unduly exposing the pilot light to the wind. The radial offset further shields the pilot gas nozzle 115 and ignition source 116 from rain, snow, etc. As least one other exhaust aperture 148 is formed in the distal surface 146, adjoining the flame retention chamber 134. As shown in FIG. 1B, an exhaust aperture 148 is positioned in distal surface 146 directly above a flame retention chamber 134. The exhaust aperture 148 is preferably comprised of a plurality of perforations which serve to diffuse air potentially entering the flame retention chamber due to turbulence or a general downward flow. However, the exhaust aperture 148 could be a single opening like aperture 148*a* or an opening provided with a mesh (not shown). As shown in FIG. 1B, when the inner peripheral skirt 142 contacts the corners of the void former 110 at the distal end 130, there could be said to be multiple flame retention chambers 134, although it will be noted that since the inner peripheral skirt 142 does not project proximally past the plane 111 and nominal waterline "W" (as shown in FIGS. 5-6), such chambers 134 are not actually isolated from each other and may intercommunicate close to the waterline. As also shown in FIG. 1B near the apertures 148 and 148*a*, the lid 140 may include depending tabs which engage the distal end 130 of the tubular void former 110 to orient and locate the lid with respect to the distal end 140, the communicating aperture 113, and any other communicating apertures 135.

Figure 3:
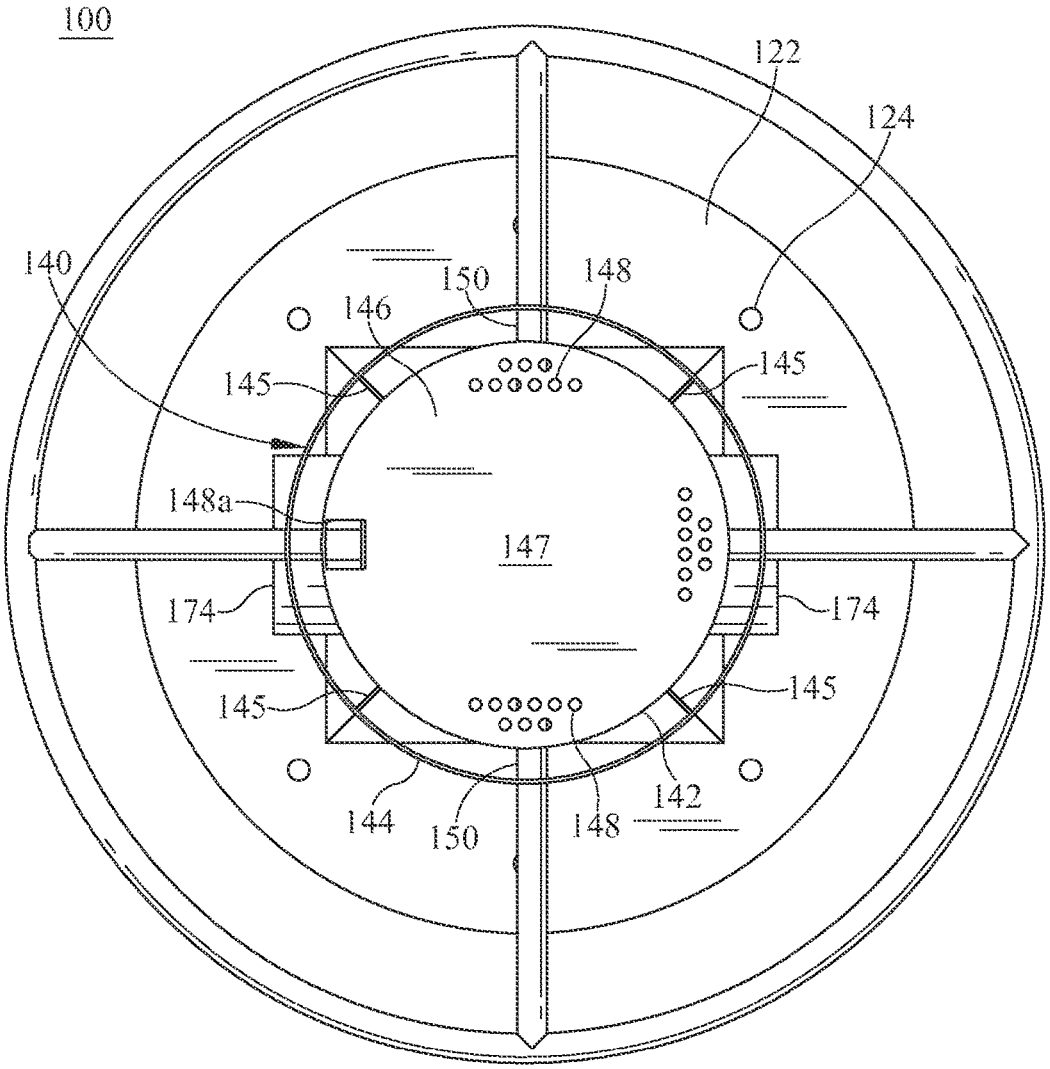
FIG. 3 is a top view of the embodiment.

At least one communicating aperture 136 is disposed in the sidewall 112 adjacent the flame retention chamber 134, between the distal end 130 of the tubular void former 110 and the plane 111/nominal waterline "W." Preferably there will be multiple communicating apertures 136 arrayed around the periphery of the distal end 130 of the tubular void former 110. As indicated by the combination of FIGS. 1B, 2, and 3, there may be multiple flame retention chambers 134, with at least one communicating aperture 136 adjoining each flame retention chamber 134, preferably adjacent to exhaust apertures 148 in the lid 140. Communicating aperture(s) 136 may be comprised of a plurality of perforations which may diffuse air transiting the sidewall 112 from the interior of the tubular void former 110 to the flame retention chamber 134 or vice versa. However, communicating aperture(s) 136 could be single openings, depending slots, or openings or slots provided with a mesh (not shown). The sum of the area of the communicating aperture openings should be greater than the area of the exhaust aperture 148*a*. Preferably the periphery of the distal end 130 is configured to be substantially open above the nominal waterline "W," i.e., capable of supplying sufficient combustion air to the pilot flame but capable of resisting spill-over of water due to ordinary disturbances such as or ripples caused by the wind or small objects thrown into the water. The communicating aperture(s) 136 may supply combustion air to the flame retention chamber 134 from inside the tubular void former 110 and/or provide an additional path for exhaust products from the pilot flame to exit from the tubular void former 110 under the distal surface 146 of the lid 140. Where there are multiple flame retention chambers, the communicating apertures 148 may also provide an additional path for flame propagation between flame retention chambers, as well as between the pilot flame and any unlit flame retention chamber.

The gas burner assembly 100 has at least one gas manifold arm 150 extending through and outward from the sidewall 112 of the tubular void former 110. As best seen in FIG. 3, a gas manifold arm 150 may extend radially outward from the sidewall 112, but in other embodiments could extend in any outwardly oriented path from the sidewall. The gas manifold form 150 extends outward from a point 152 between the plane 111/nominal waterline "W" and proximal end 120. In preferred embodiments, a proximal side 154 of the gas manifold arm 150 is disposed about ½" from the plane 111 and nominal waterline "W+/−¼". In other embodiments, the proximal side 154 may be disposed about 1" form the plane 111 and nominal waterline "W"+/−¼", or potentially, but less advantageously, at greater separation distances, since the separation distance will affect the combustible gas pressure that must be present at the burner assembly, and may preclude long, standard diameter piping connections to in-home distribution systems operated at the low end of "standard pressure." The gas manifold arm 150 may subsequently form any of a variety of closed or open, regular or irregular shapes. Multiple gas manifold arms 150 may extend through and outward from the sidewall 112 of the tubular void former 110 and may form separate or, preferably, interconnected portions of such shapes, for example, the illustrated circular burner shape.

Figure 4:
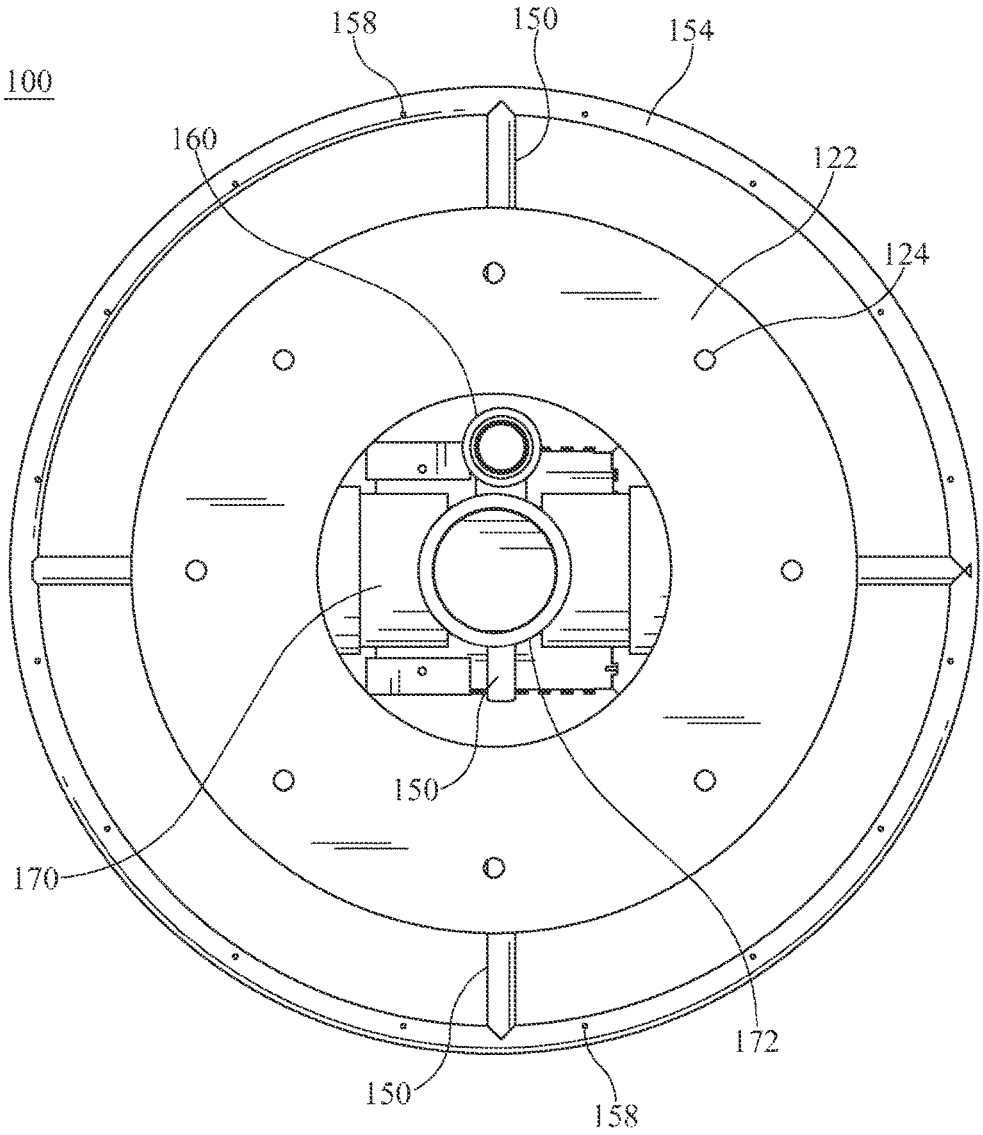
FIG. 4 is a bottom view of the embodiment.

The gas manifold arm 150 is connected to a gas supply line 160 disposed within the tubular void former 110. As shown in FIGS. 4 and 5, the gas supply line may run from a point proximally disposed from the plane 111/nominal waterline "W," preferably from at least the proximal end 120 of the tubular void former 110, to about the distal end 130 of the tubular void former, and then connect to gas manifold arms 150. As shown, the gas supply line 160 runs back to a the axial position of the gas manifold arms 150 and formed shape, but the gas manifold arms 150 could be formed so as to meet the gas supply line 160 distally from the plane 111/nominal waterline "W." These configurations serve to produce a gas break, preventing any water which infiltrates that gas manifold arm from flowing into the gas connection through the gas supply line 160.

The gas manifold arm 150 includes at least one gas port 156 disposed proximate the sidewall 112 of the tubular void former 110. Proximate in this context means at or inside the axially projected radial position of the inner peripheral skirt 142, such that gas existing the gas port 156 will generally emerge from the water of the water feature within the radial bounds of the outer and inner peripheral skirts 144, 142. Accordingly, gas expelled from the at least one gas port 156 supplies fuel to the flame retention chamber 134. Where multiple gas manifold arms are present, each arm may include a gas port 156 disposed proximate the sidewall, and may thus supply fuel to the flame retention chamber 134 at multiple locations, or to each of several semi-separated flame retention chambers 134. The more outward portions of the gas manifold arm 150 may include a plurality of other gas ports 158 disposed remotely from the sidewall 112 (outside the axially projected radial position of the inner peripheral skirt) in order to supply fuel for an open flame to be maintained on the open surface of the water of the water feature. The gas port(s) 156 and 158 are preferably holes having a diameter of about 0.06"+0.04"/−0.03". The small diameter of the gas ports 156 and 158 uses the surface tension of water in the water feature to resist infiltration of water within the gas manifold arm. Preferably, as shown in FIGS. 2 and 4, gas ports 156 and 158 are disposed on the proximal side 154 of gas manifold arm(s) 150. The proximal placement of the gas ports further resists infiltration of water within the gas manifold arm by resisting bulk migration of the combustible gas out of the ports, e.g., bubbling, after the gas burner 100 has been shut off and is essentially quiescent. In the illustrated embodiment, having a generally circular outward configuration, gas ports 158 may pitched inwards toward a central longitudinal axis of the burner assembly such that most of the released fuel will tend to emerge from the water within the area bounded by the manifold arms 150. The inward pitch will tend to concentrate the released fuel in proximity to the flame retention chamber(s) 134, reducing the proportion of fuel that might escape combustion.

The gas burner assembly may optionally include a water manifold 170 for use in circulating water within a water feature. As illustrated, the water manifold 170 forms a tee fitting having an inlet 172 (shown in FIGS. 2 and 4) disposed within the tubular void former 110 and a pair of opposed outlets 174 disposed in the sidewall 112 of the tubular void former. It will be appreciated that the number of inlets 172 and outlets 174 may vary, and that in use the outlets 174 may be coupled to submerged tube diffusers, nozzles, jets, or the like as well as surface sprayers, nozzles, jets, etc. Water manifold 170 would, in use, be connected to an external pump or other pressurized supply of water to provide for either basic circulation of water within a water feature or aesthetically pleasing water effects.

Figure 7:
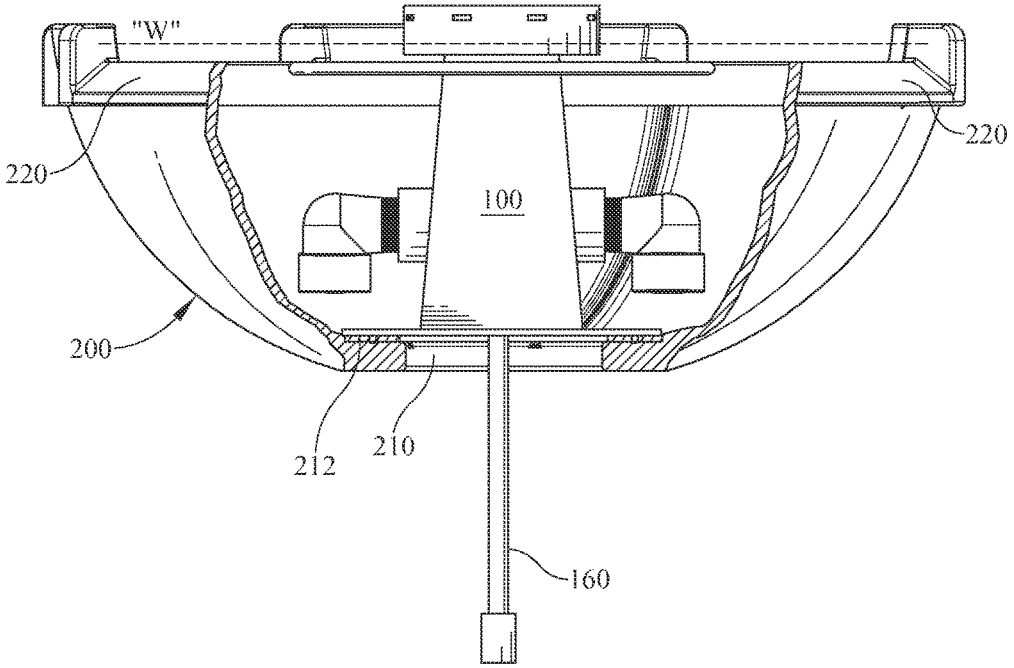
FIG. 7 is a side view of the embodiment installed within an artificial water feature. An exemplary bowl is shown in a side, cut-away view.

As shown in FIG. 7, the semi-submersible gas burner assembly 100 may be combined with a bowl 200 to form an operable fire-on-water feature. The bowl 200 has a nominal waterline "W" and an passage 210 disposed below the nominal waterline. The passage 210 may be a simple aperture or an aperture surrounded by a fitting 212 such as flush or raised flange fitting, a threaded fitting, a bayonet-connection fitting, etc. Fitting 212 is shown for illustrative purposes as a flush flange for mutual engagement with the flange 122 of the gas burner assembly 100. The water level in the bowl may be passively maintained at the level of the nominal waterline "W," but preferably is actively maintained at the level of the nominal waterline via a pump, which may add water via outlets 174. The water level may be maintained in an active system by a drainage standpoint open at the nominal waterline, or as shown by one or more scuppers 220 which permit water to overflow from the bowl 200 and into a collector pool or, more typically, a sump disposed under a permeable cover. The combination advantageously permits the plane 111 and intended nominal waterline of the gas burner assembly 100 to match by design the nominal waterline "W" of the bowl 200, rather than require the use of spacers, adapters, extensions, and the attendant additional gaskets or seals generally required to control leakage from the bowl 200. For sake of clarity, nominal waterline "W" is shown at an exaggerated distance above the base of the scuppers 220, however it is noted that with pumping and active maintenance of the water level the operating waterline will actually be higher than the base of any scuppers or standpipe, The embodiment of the invention shown in the drawings and described above is but one example of numerous embodiments that may be made from the variations, modifications, and alternatives discussed herein. It is the applicant's intention that the scope of the patent issuing herefrom will be limited only by the scope of the claims and specific definitions provided herein.

What is claimed is:

1. A semi-submersible gas burner assembly comprising:

a tubular void former having a proximal end, a distal end, and a nominal waterline defining a plane disposed between the proximal and distal ends;

a lid engageable with the distal end of the tubular void former, the lid including an inner peripheral skirt disposed outside of and spaced apart from the tubular void former, the inner peripheral skirt projecting toward the plane when the lid is engaged with the tubular void former, an outer peripheral skirt disposed outside of and spaced apart from the inner peripheral skirt, the outer peripheral skirt projecting toward and past the plane when the lid is engaged with the tubular void former, and a distal surface substantially closing off an area of the lid bounded by the inner peripheral skirt; and at least one gas manifold arm extending through and outward from a sidewall of the tubular void former, the gas manifold arm including at least one gas port formed in the outward portion of the gas manifold arm proximate the sidewall of the tubular void former;

wherein the sidewall of the tubular void former includes a communicating aperture disposed between the distal end of the tubular void former and the plane, the communicating aperture fluidly interconnecting the interior of the tubular void former with a flame retention chamber defined by the sidewall of the tubular void former, the distal surface of the lid, the inner peripheral skirt, and the nominal waterline.

2. The gas burner assembly of claim 1, wherein the distal surface includes a plurality of exhaust apertures, and the plurality of exhaust apertures constitute less than 14 percent of the area.

3. The gas burner assembly of claim 2, wherein the plurality of exhaust apertures constitute less than 7 percent of the area.

4. The gas burner assembly of claim 2, further comprising an electronic ignition module disposed in the tubular void former at the distal end, wherein the sidewall, the distal surface, and the electronic ignition module form a pilot combustion chamber disposed within the tubular void former.

5. The gas burner assembly of claim 4, wherein the electronic ignition module includes a pilot gas nozzle, and the communicating aperture is directly adjacent the pilot gas nozzle.

6. The gas burner assembly of claim 5, wherein at least one exhaust aperture of the plurality of exhaust apertures is adjacent to the communicating aperture.

7. The gas burner assembly of claim 6, wherein the at least one exhaust aperture has an area equivalent to an opening of ⅝" by ½", plus or minus ⅛" in each dimension.

8. The gas burner assembly of claim 1, wherein the outer peripheral skirt includes a plurality of inlet apertures disposed proximate the distal end of the outer peripheral skirt.

9. The gas burner assembly of claim 1, wherein the gas manifold arm extends outward from the sidewall such that a proximal side of the manifold arm is disposed about 1" plus or minus ¼" away from the plane in the direction of the proximal end of the tubular void former.

10. The gas burner assembly of claim 9, wherein the at least one gas port is disposed in the proximal side of the manifold arm and has a diameter of about 0.06".

11. A fire effect system comprising:

a bowl for a water feature, the bowl having a nominal waterline and a passage disposed below the nominal waterline; and a semi-submersible gas burner assembly sealingly engagable with the passage; the semi-submersible gas burner assembly comprising:

a tubular void former having a proximal end engaging the bowl about the passage and an opposing distal end;

a lid engageable with the opposing distal end, the lid including an inner peripheral skirt disposed outside of and spaced apart from the tubular void former, the inner peripheral skirt projecting toward the nominal waterline when the lid is engaged with the tubular void former, an outer peripheral skirt disposed outside of and spaced apart from the inner peripheral skirt, the outer peripheral skirt projecting toward and past the nominal waterline when the lid is engaged with the tubular void former, and a distal surface substantially closing off the area of the lid bounded by the inner peripheral skirt; and at least one gas manifold arm extending through and outward from a sidewall of the tubular void former, the gas manifold arm having at least one gas port formed in the outward portion of the gas manifold arm proximate the sidewall of the tubular void former;

wherein the sidewall of the tubular void former includes a communicating aperture disposed between the distal end of the tubular void former and the nominal waterline, the aperture fluidly interconnecting the interior of the tubular void former with at least one flame retention chamber defined by the sidewall of the tubular void former, the distal surface of the lid, the inner peripheral skirt, and the nominal waterline of the bowl.

12. The fire effect system of claim 11, wherein the distal surface includes a plurality of exhaust apertures, and the plurality of exhaust apertures constitute less than 14 percent of the area.

13. The fire effect system of claim 12, further comprising an electronic ignition module disposed in the tubular void former at the distal end, wherein the sidewall, the distal surface, and the electronic ignition module form a pilot combustion chamber disposed within the tubular void former.

14. The fire effect system of claim 13, wherein the electronic ignition module includes a pilot gas nozzle, and the communicating aperture is directly adjacent the pilot gas nozzle.

15. The fire effect system of claim 14, wherein at least one exhaust aperture of the plurality of exhaust apertures is adjacent to the communicating aperture.

16. The fire effect system of claim 15, wherein the at least one exhaust aperture has an area equivalent to an opening of ⅝" by ½", plus or minus ⅛" in each dimension.

17. The fire effect system of claim 11, wherein the gas manifold arm extends outward from the sidewall such that a proximal side of the manifold arm is disposed about 1" plus or minus ¼" away from the plane in the direction of the proximal end of the tubular void former.

18. The fire effect system of claim 17, wherein the at least one gas port is disposed in the proximal side of the manifold arm and has a diameter of about 0.06".

19. The fire effect system of claim 11, wherein the proximal end of the tubular void former includes a outwardly projecting flange, and the passage of the bowl is surrounded by a flush flange, the respective flanges being mutually engaged for sealing of the passage.

20. The fire effect system of claim 11, wherein the tubular void former includes a water manifold, the water manifold having an inlet disposed within the tubular void former and a plurality of outlets disposed in the sidewall of the tubular void former.

* * * * *